US005871036A

United States Patent [19]

Murayama et al.

[11] Patent Number: 5,871,036

[45] Date of Patent: Feb. 16, 1999

[54] TWISTING AND TIGHTENING MECHANISM IN REINFORCEMENT BINDING MACHINE

[75] Inventors: Keijiro Murayama; Ichiro Kusakari; Atsushi Miyazaki; Syuichi Ishii, all of Tokyo, Japan

[73] Assignee: Max Co., Ltd., Tokyo, Japan

[21] Appl. No.: 672,546

[22] Filed: Jun. 28, 1996

[30] Foreign Application Priority Data

| | | | |
|---|---|---|---|
| Dec. 14, 1905 | [JP] | Japan | 7-347249 |
| Jun. 30, 1995 | [JP] | Japan | 7-188124 |
| Jun. 30, 1995 | [JP] | Japan | 7-188125 |
| Dec. 14, 1995 | [JP] | Japan | 7-347251 |

[51] Int. Cl.[6] ..... B21F 15/04

[52] U.S. Cl. ..... 140/119; 140/57

[58] Field of Search ..... 140/57, 93 A, 140/93.2, 93.6, 119

[56] References Cited

U.S. PATENT DOCUMENTS

| | | | |
|---|---|---|---|
| 4,362,192 | 12/1982 | Furlong et al. | 140/119 |
| 4,508,030 | 4/1985 | Grenon | 140/119 |
| 4,610,067 | 9/1986 | Hara | 140/93 A |
| 5,279,336 | 1/1994 | Kusakari et al. | 140/119 |
| 5,323,816 | 6/1994 | Hoyaukin | 140/57 |
| 5,657,799 | 8/1997 | Kusakari et al. | 140/199 |
| 5,678,613 | 10/1997 | Murayama et al. | 140/119 |
| 5,694,983 | 12/1997 | Kusakari et al. | 140/119 |

FOREIGN PATENT DOCUMENTS

| | | |
|---|---|---|
| 0 190 071 | 8/1986 | European Pat. Off. . |
| 0 249 737 | 12/1987 | European Pat. Off. . |
| 2 552 364 | 3/1985 | France . |
| 2 410 661 | 11/1974 | Germany . |
| 986325 | 3/1965 | United Kingdom . |

*Primary Examiner*—Lowell A. Larson
*Attorney, Agent, or Firm*—Morgan, Lewis & Bockius LLP

[57] ABSTRACT

In a reinforcement binding machine in which a wire feed device feeds externally therefrom a wire for binding reinforcements and the wire fed out by the wire feed device is bent in a loop shape by a guide part, a twisting-and-tightening mechanism comprises: a pair of hooks being capable of opening and closing, for gripping in part the wire wound around the reinforcements in the loop shape; a driver for rotating the hooks in a direction to twist the wire gripped and for selectively moving the hooks toward or apart from the reinforcements with the wire wound therearound; and a coil spring for urging the hooks such that the hooks are normally spaced apart from the reinforcements.

9 Claims, 15 Drawing Sheets

TWISTING AND TIGHTENING MECHANISM IN REINFORCEMENT BINDING MACHINE

BACKGROUND OF THE INVENTION

The present invention relates to a binding wire twisting and tightening mechanism in a reinforcement binding machine which, after a binding wire is sent out in a loop shape and is wound around reinforcements, twists part of the binding wire to thereby tighten the same.

Generally, when placing a reinforced concrete on a building or a structure, a concrete is placed after reinforcements arranged so as to intersect each other vertically and horizontally are bound together and, recently, an operation to bind the reinforcements together has been carried out by a reinforcement binding machine. As an example of such reinforcement binding machine, there is known a reinforcement binding machine, in which, as shown in Japanese Utility Model Application Laid-open No. Hei. 5-3494 filed by the present applicants, a wire is wound around reinforcements in a loop shape and, after then, the looped portion of the wire is in part gripped and rotated by a pair of twisting hooks to thereby twist and tighten the wire so that the reinforcements can be fixed.

The above-mentioned hooks are normally situated in the rear of the looped portion of the wire and, after the wire is wound around the reinforcements, the hooks can grip the wire to twist and tighten the same. In this case, there is necessary a pulling operation that, after the reinforcement binding machine is pulled toward an operator to thereby cause the looped portion of the wire to be tensed, the wire is closely contacted with the intersecting portions of the reinforcements before the wire is twisted.

Also, by pulling the reinforcement binding machine toward the operator, a tensile force is given to the looped portion of the wire, which in turn causes the winding and tightening force of the wire to increase. However, as shown in FIG. 23, the twisted portion 121 of the wire 120 is caused to rise up long in a direction perpendicular to the surfaces of the reinforcements a and, therefore, if the concrete is placed while the wire twisted portion 121 remains as it is, then the wire twisted portion 121 is exposed out from the surface of the concrete. This requires a troublesome operation to bend the wire twisted portion 121 in such a manner as shown by an arrow 122 after twisted, while the bending of the wire twisted portion 121 loosens the tension of the wire 120 to thereby lower the reinforcements binding force of the wire 120.

In view of the above, as disclosed in Japanese Patent Application No. Hei. 7-79896, there is provided a technique in which a wire is twisted and tightened while the distance between the twisted portion of the wire and the reinforcements is maintained at a given level. However, according to this technique, although the loop diameter of the wire can be reduced by twisting the wire, any special resistance or tensile force cannot be applied to the wire during the wire twisting operation. Also, the twisting hooks are structured such that their rotational movements can be stopped when they detect only the twisting torque in the wire twisted portion but cannot be stopped by the total winding and tightening force thereof. Therefore, according to the disclosed technique, the whole binding force obtained is unstable.

There is known another binding machine which is disclosed in Japanese Utility Model Application Laid-open No. Hei. 5-92103. In this reinforcement binding machine, after a binding wire is fed out and guided from a wire reel, around which the binding wire is wound, in such a manner that the wire can be wound in a loop shape around the peripheries of reinforcements to be bound together, the thus wound wire is cut off from the wire wound around the wire reel, and part of the wire wound in a loop shape is gripped and twisted, so that the reinforcements can be bound together. However, since the leading and trailing ends of the wire are free when the wire is twisted, they are easy to be swung in various directions with respect to the reinforcements binding portion of the wire. In view of this, the leading end of the wire can be adjusted according to the amount of feeding of the wire so that it comes near the reinforcements binding portion of the wire.

However, the terminal end of the wire is fixed to a cutting mechanism, and the position where the end of wire is fixed is far from a twisting mechanism. When the reinforcement binding machine is pulled apart from the binding wire, the terminal end 204*a* of the wire 204 binding the reinforcements 206 should be normally situated at such a position as shown by a dotted line in FIG. 24. Actually, due to the above-mentioned reasons, the wire terminal end 204*a* can be caught by part of the reinforcement binding machine or by part of the reinforcements so that the terminal end 204*a* can be swung beyond the covering thickness of the concrete 218. In this case, since the wire terminal end 204*a* is exposed externally of the concrete 218, there is a possibility that rain water can penetrate into the concrete through this and the exposed portion of the wire terminal end 204*a* can be oxidized to thereby cause a crack.

Not only that, in this reinforcement binding machine, as shown in FIG. 25, when the twisting hooks are rotated for twisting the wire 320, the wire 320 is swung right and left, with the result that the winding portion of the wire 320 can be shifted from the best position that is shortest in distance from the mutually intersecting portions of the reinforcements 321.

Since the wire twisting mechanism is caused to stop when the twisting torque of the wire reaches a given value, the swinging of the wire can also be corrected. However, since the reinforcements 321 respectively include ribs 322, when the wire 320 is in engagement with the ribs 322, the wire 320 is swung in such a manner as shown in FIG. 25 and is thereby bound in such a manner that it is extended longer than expected. In this case, when the concrete is placed, the engagement between the wire and ribs can be removed to thereby unstabilize the bound condition of the reinforcements.

SUMMARY OF THE INVENTION

Under the above-mentioned circumstances of the prior art, the present invention aims at eliminating the above-mentioned drawbacks.

Accordingly, it is an object of the invention to provide a wire twisting and tightening mechanism in a reinforcement binding machine which, when twisting a wire wound around reinforcements, applies a tensile force to the wire to thereby be able to bind together the reinforcements positively and stably.

It is another object of the invention to provide a binding wire winding and tightening mechanism for use in a reinforcement binding machine in which, by applying a resistance to a wire wound around reinforcements while the wire is wound and tightened, a tensile force is applied to the wire to thereby be able to bind the reinforcements together stably.

It is further object of the invention to provide a wire terminal end swing preventive mechanism for use in a reinforcement binding machine, which can hold the terminal end of a cut wire near the cutting position of the wire until the twisting of the wire is completed to thereby prevent the terminal end of the wire from being swung excessively when the reinforcement binding machine is pulled apart from the wire that has bound the reinforcements together.

It is still further object of the invention to provide a wire guide mechanism for use in a reinforcement binding machine, which, in a wire binding operation, can guide a wire in such a manner that the wire is prevented from being swung, thereby being always able to bind the reinforcements stably.

To achieve the objects, according to a first aspect of the present invention, there is provided a twisting-and-tightening mechanism for a reinforcement binding machine in which a wire feed device feeds externally therefrom a wire for binding reinforcements and the wire fed out by the wire feed device is bent in a loop shape by a guide part, the twisting-and-tightening mechanism comprising: twisting means having a pair of hooks being capable of opening and closing, for gripping in part the wire wound around the reinforcements in the loop shape; means for rotating the twisting means in a direction to twist the wire gripped by the hooks and for selectively moving the twisting means toward or apart from the reinforcements with the wire wound therearound; and means for urging the twisting means such that the twisting means is normally spaced apart from the reinforcements.

According to a second aspect of the invention, there is a tension applying mechanism for a reinforcement binding machine in which a wire feed device feeds externally therefrom a wire for binding reinforcements, the wire fed out by the wire feed device is bent in a loop shape by a guide part, and a twisting-and-tightening mechanism twists and tightens the wire thus bent in the loop shape, the tension applying mechanism comprising: a pair of resistance plates, each having C-shape, which are disposed inside the wire to be wound around in the loop shape and are engageable with the wire during the wire twisting operation by the twisting-and-tightening mechanism, for applying elastically resistance to the wire; and means for bring the resistance plate in contact with each other in a predetermined strength.

According to a third aspect, there is provided a wire cut and swing-preventive mechanism for a reinforcement binding machine in which a feed mechanism feeds out a binding wire to be wound in a loop shape around reinforcements to be bound and a twisting mechanism grips and twists in part the wire wound in a loop shape, the wire cut and swing-preventive mechanism comprising: a cutting mechanism for cutting the wire; and hold means disposed in the neighborhood of the cutting mechanism, for holding the terminal end portion of the wire thus cut and the neighboring portion thereof.

According to a fourth aspect of the invention, there is provided a wire guide mechanism for a reinforcement binding machine in which a feed mechanism feeds out a binding wire to be wound in a loop shape around reinforcements to be bound and a twisting mechanism grips and twists in part the wire wound in a loop shape, the wire guide mechanism comprising: a longitudinally extending slit-shaped guide part formed in front of the wire twisting mechanism, for guiding the wire thus fed out, the guide part being spreadable in the width thereof.

When put into operation, the present reinforcement binding machine winds a wire fed out from a wire feed device around reinforcements in a loop shape, and further closes a pair of hooks serving as twisting means to thereby grip and twist part of the looped wire so that the reinforcements can be wound and tightened by the wire. In this operation, since the diameter of the loop portion of the wire becomes smaller as the wire is twisted and thus the twisted portion of the wire becomes tensed, the twisting means is pulled toward the reinforcements but, however, because the twisting means is energized by a spring in the opposite direction, the free movement of the twisting means is restricted by the spring resistance and thus the wire is twisted and tightened with the tensile force applied to the twisted portion of the wire, so that the wire can be firmly wound and tightened around the reinforcements.

Therefore, according to the invention, the reinforcements can be bound together by a wire positively and stably.

According to the present binding wire winding and tightening mechanism, after the wire is fed out by the wire feed device and is wound in a loop shape two or more times around the intersecting portions of the reinforcements a by the guide part, the twisting hooks grip part of the looped portion of the wire and then twist and rotates the wire. This winds and tightens the intersecting portions of the reinforcements and, during this winding and tightening operation, the diameter of the looped portion of the wire is gradually reduced to thereby bring the wire loop portion into engagement with resistance plates respectively provided inside the wire, so that a resistance can be elastically applied to the winding and tightening force of the wire. Due to this, a tensile force can be applied to the wire while the wire is being twisted. And, if the diameter of the loop portion of the wire is reduced further, then the wire is removed from the resistance plates and thus can wind and tighten the reinforcements.

BRIEF DESCRIPTION OF THE DRAWINGS

FIG. 16(*b*) is a section view taken along the line A—A in FIG. 16(*a*);

DETAILED DESCRIPTION OF THE PREFERRED EMBODIMENTS

Figure 1:
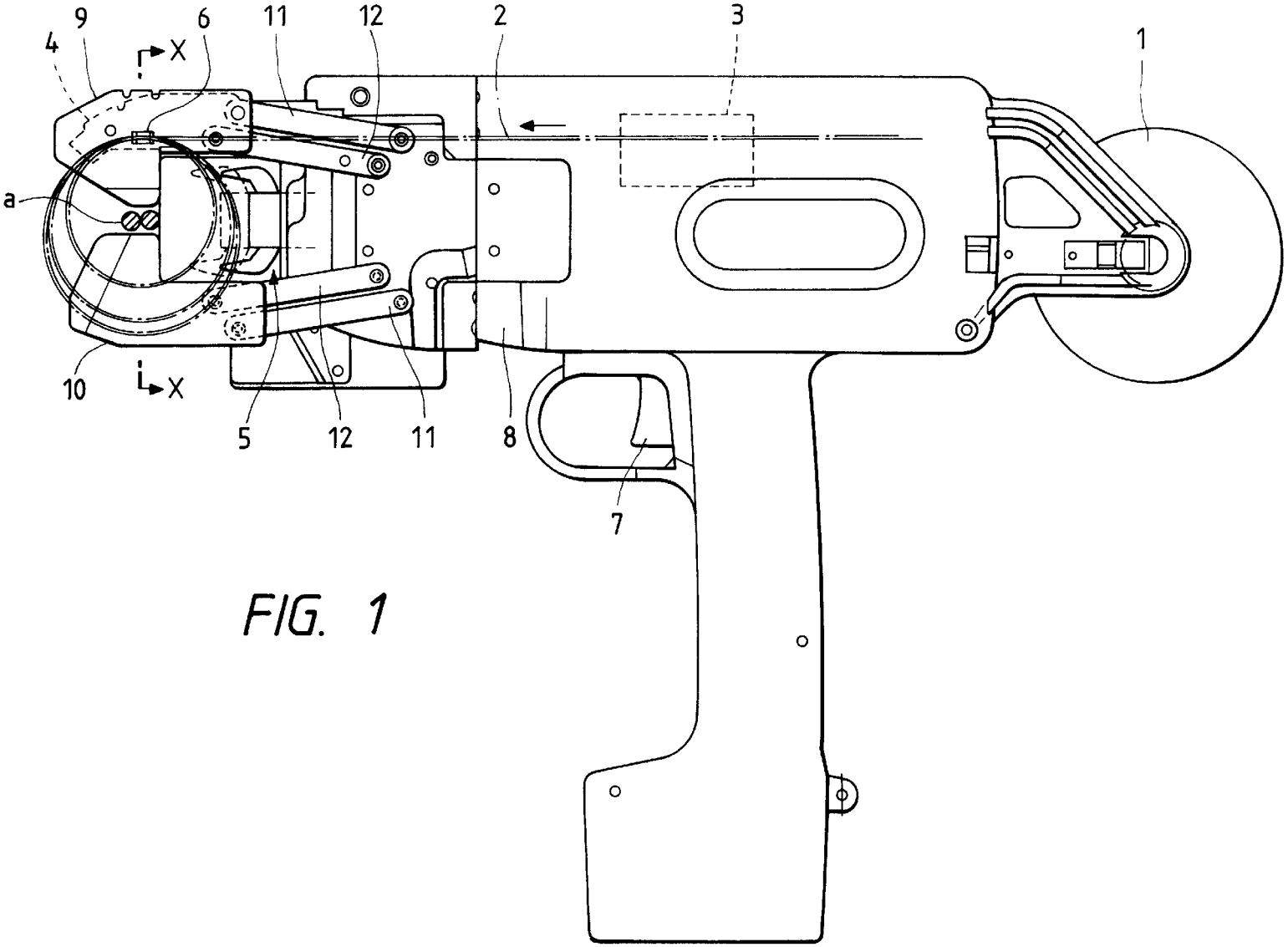
FIG. 1 is a section view of the general structure of a reinforcement binding machine according to the invention.
Figure 2:
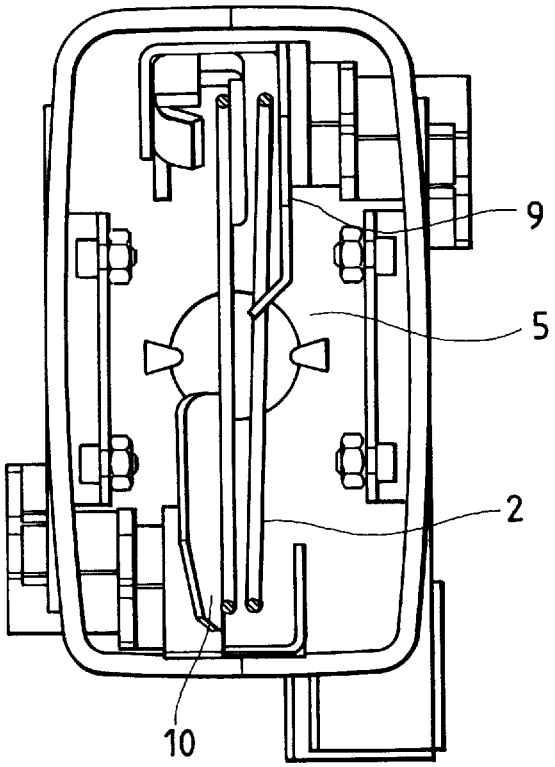
FIG. 2 is a section view taken along the line X—X in FIG. 1.

Now, FIGS. 1 and 2 respectively show an embodiment of a reinforcement binding machine according to the invention. The present reinforcement binding machine comprises a wire feed device 3 for feeding out forwardly therefrom a wire 2 wound around a spool 1, a guide part 4 for guiding the fed-out wire 2 so that the wire can be wound in a loop shape around the mutually intersecting portions of reinforcements a, and a cutting device 6 for cutting off the looped portion of the wire 2 from the base portion of the wire 2. By an operation of a trigger lever 7, after the wire 2 fed out by the wire feed device 3 is wound around the reinforcements a in a loop shape and is cut, part of the looped wire is griped and rotated by the twisting means 5 to twist and wind the wire 2 tightly around the reinforcements a, so that the reinforcements a can be bound together. The wire feed device 3, twisting means 5, and cutting device can be operated by a motor (not shown). And, the basic structures and operations of these devices are the same as those disclosed in the above-mentioned publications.

Next, in a main body 8 of the binding machine, in order to prevent the looped portion of the wire 2 from swinging in a direction at right angles to the diametrical direction thereof, there are provided in the upper and lower portions thereof a pair of guide arms 9 and 10 which are used to hold inside them the wire 2 that is fed out from the guide part 4 and wound around in a loop shape. The two guide arms 9 and 10 are connected to the binding machine main body 8 respectively through two parallel links 11 and 12 and are structured such that the distance between them can be adjusted according to the thicknesses of reinforcements used.

Figure 3:
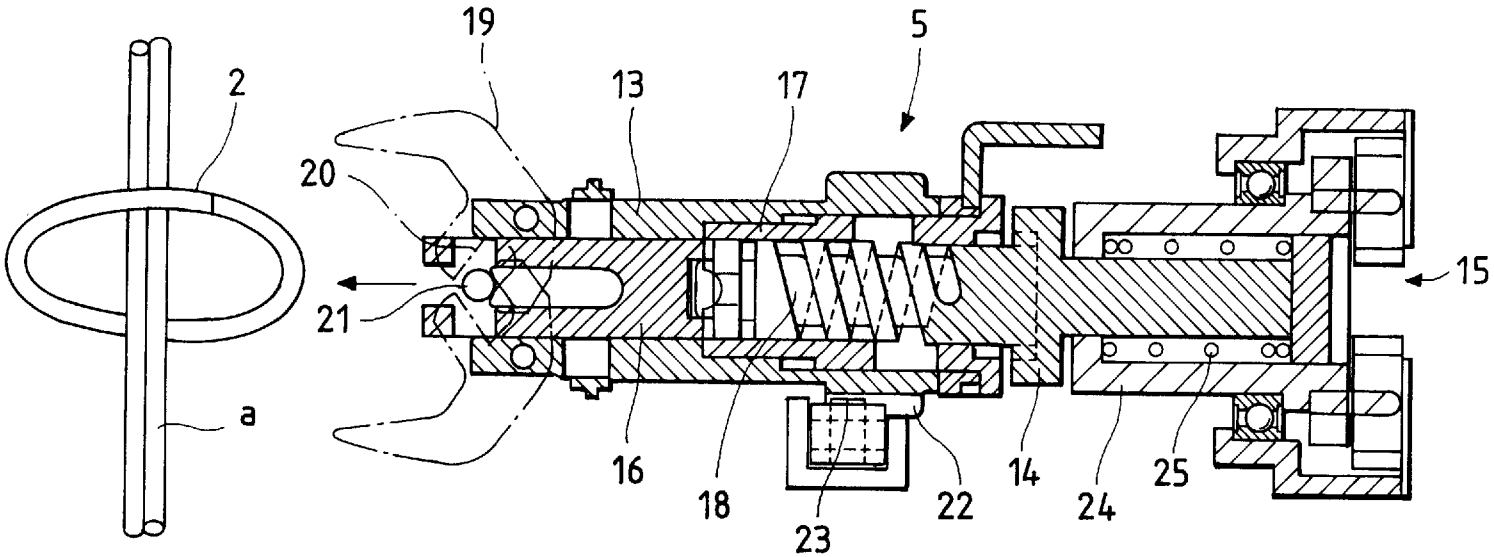
FIG. 3 is a longitudinal section view of a twisting means portion of the above reinforcement binding machine.

Referring now to the structure of the twisting means 5, as shown in FIG. 3, a cylindrical body 13, which is an applied structure of a ball screw, and a screw rod 14 are respectively connected to a planetary gear device 15, and the screw rod 14 is energized backwardly by a spring. That is, the screw rod 14, which includes at the front end thereof a projecting rod 16 which can be rotated freely, is fitted into the cylindrical body 13. An inner cylinder 17 is fixed to the inside of the rear portion of the cylindrical body 13 and is threadedly engaged with a screw portion 18 formed in the front portion of the screw rod 14. In the front end portion of the cylindrical body 13, there are supported a pair of twisting hooks 19 in such a manner that they can be freely opened and closed, while a pivot 21 provided in the projecting rod 16 is engaged with recessed portions 20 respectively formed in the base ends of the hooks 19. Also, the cylindrical body 13 is movable in the direction of the axis thereof and is rotatable around the axis, while, in the outer surface of the rear end of the cylindrical body 13, there is provided an engaging projection 22 which extends in the longitudinal direction of the cylindrical body 13. On the other hand, to the side of the binding machine main body 8, there is fixed an engaging claw 23 which is engageable with the engaging projection 22. The engaging claw 23 is structured such that it can be engaged with or disengaged from the engaging projection 22 depending on the movements of the cylindrical body 13. Further, the rear portion of the screw rod 14 is spline fitted into a rotary cylinder 24, and, between a flange provided in the rear end portion of the screw rod 14 and the front wall of the rotary cylinder 24, there is interposed a coil spring 25 and thus the screw rod 14 is energized backwardly (in a direction to part from the reinforcements a) by the coil spring 25. And, the rotary cylinder 24 is in mesh with the planetary gear device 15, while the planetary gear device 15 is linked with a motor.

Figure 4:
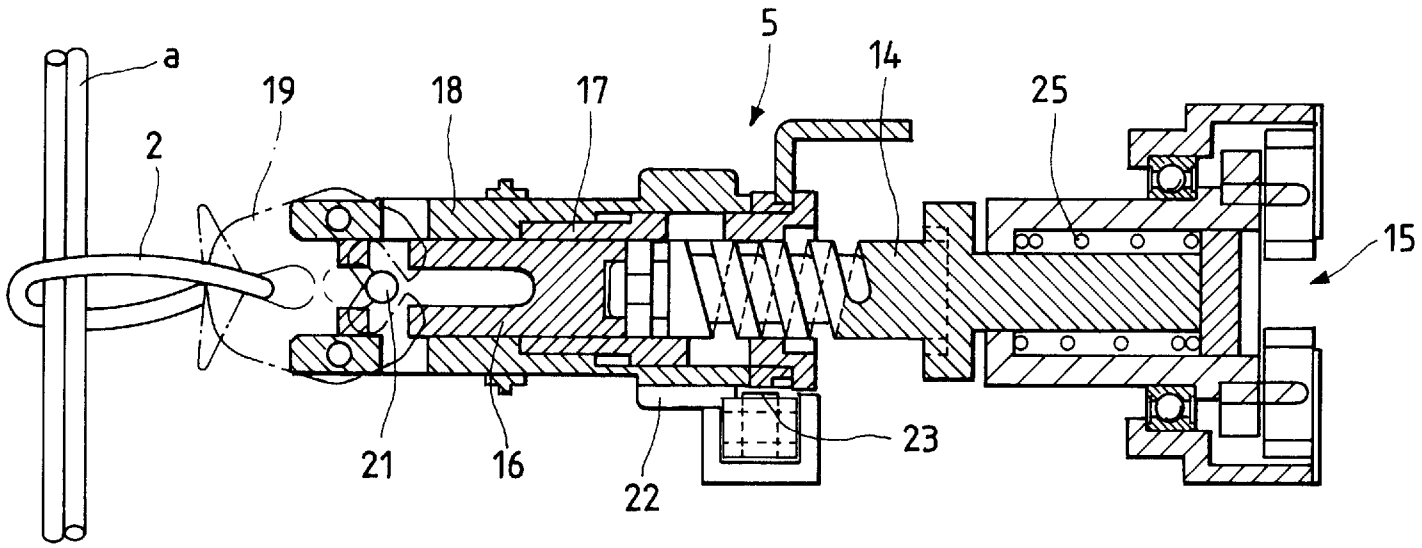
FIG. 4 is an explanatory view of an operational state of a twisting and tightening mechanism according to the invention.
Figure 5:
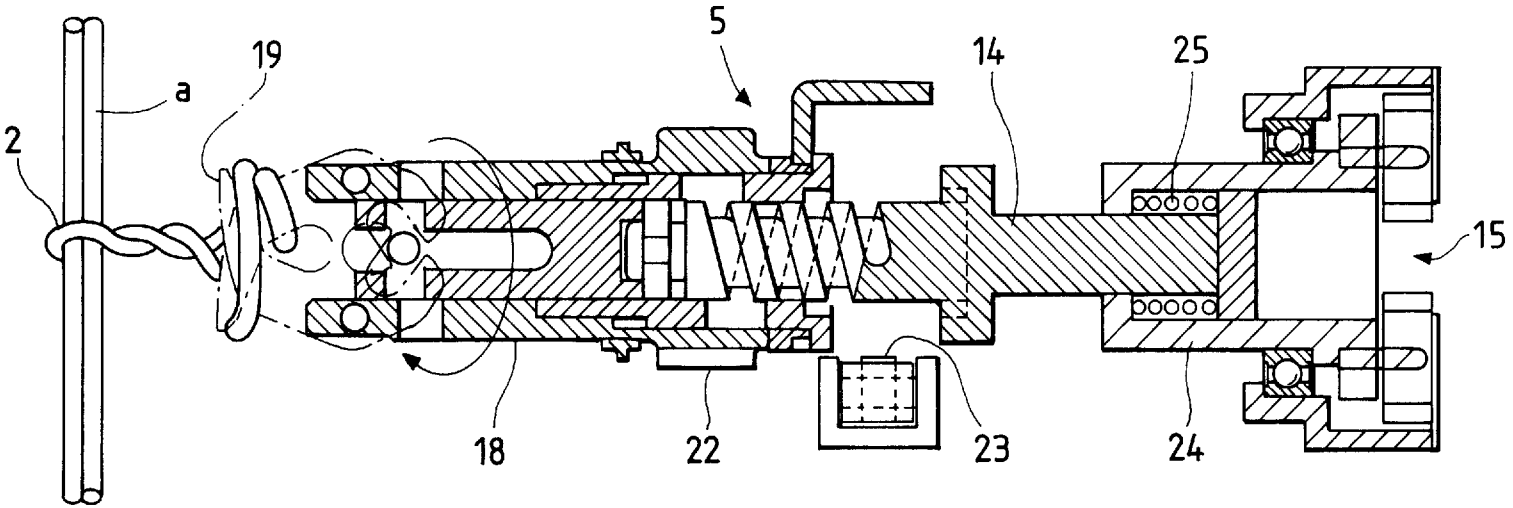
FIG. 5 is an explanatory view of another operational state of the above twisting and tightening mechanism.

According to the above-mentioned structure, the screw rod 14 is normally energized backwardly by the coil spring 25. If the planetary gear device 15 is put into operation by drive means, then the screw rod 14 is rotated together with the rotary cylinder 24. At the then time, since the engaging claw 23 is in engagement with the engaging projection 22 of the cylindrical body 13, neither the cylindrical body 13 nor the inner cylinder 17 can be rotated. For this reason, as shown in FIG. 4, the cylindrical body 13 and cylinder 17 are moved forwardly as the screw rod 14 is rotated. And, since the projecting rod 16 is moved backwardly relative to them, the hooks 19 are respectively closed to grip the wire 2. At the same time, the engaging claw 23 is removed from the engaging projection 22 and, therefore, the cylindrical body 13 is rotated about the axis thereof together with the screw rod 14, thereby causing the hooks 19 to twist the wire 2. By the way, because the wire 2 is wound and tightened during the twisting operation, the diameter of the loop of the wire 2 becomes smaller. If the diameter of the looped portion of the wire 2 becomes smaller, then the twisted portion of the wire 2 becomes tensed. And, if the wire twisted portion becomes tensed, then the screw rod 14 is pulled forwardly (in a direction to approach the reinforcements a) but, as shown in FIG. 5, since the screw rod 24 is energized backwardly by the coil spring 25, the free movement of the screw rod 24 is restricted by the resistance of the spring 25 and thus the wire 2 is twisted and tightened while a tension is being applied to the twisted portion of the wire 2. As a result of this, the wire 2 can be firmly wound and tightened around the reinforcements a, so that the reinforcement a can be bound together positively and stably.

After completion of the binding operation, if the reinforcement binding machine is pulled toward the operator, then the twisting hooks 19 can be removed from the wire 2. After then, if the screw rod 14 is rotated reversely, then the screw rod 14 can be returned to its original position and, at the same time, the hooks 19 are opened, so that preparation for a next binding operation is made.

Figure 6:
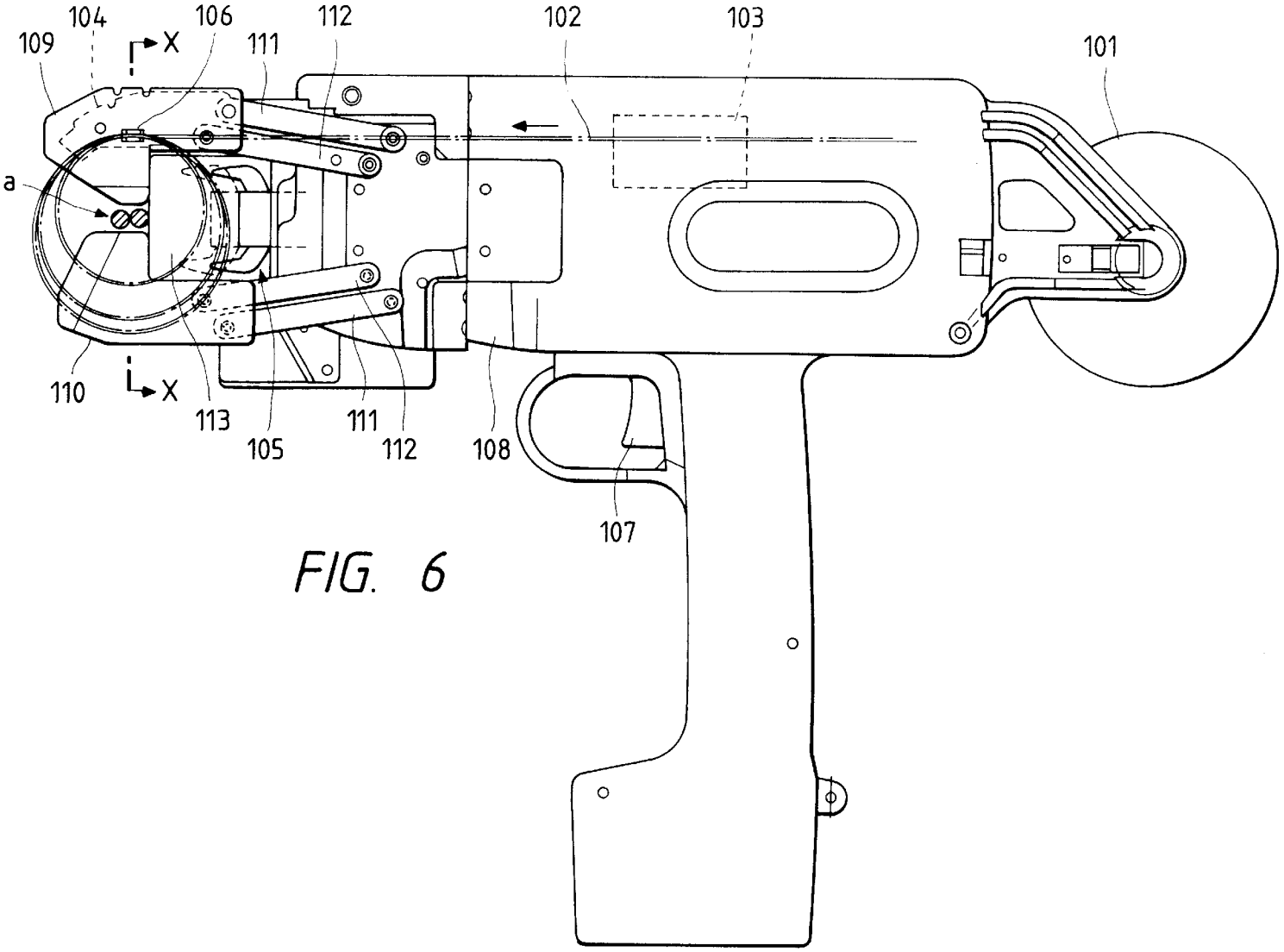
FIG. 6 is a side view of another reinforcement binding machine according to the invention.
Figure 7:
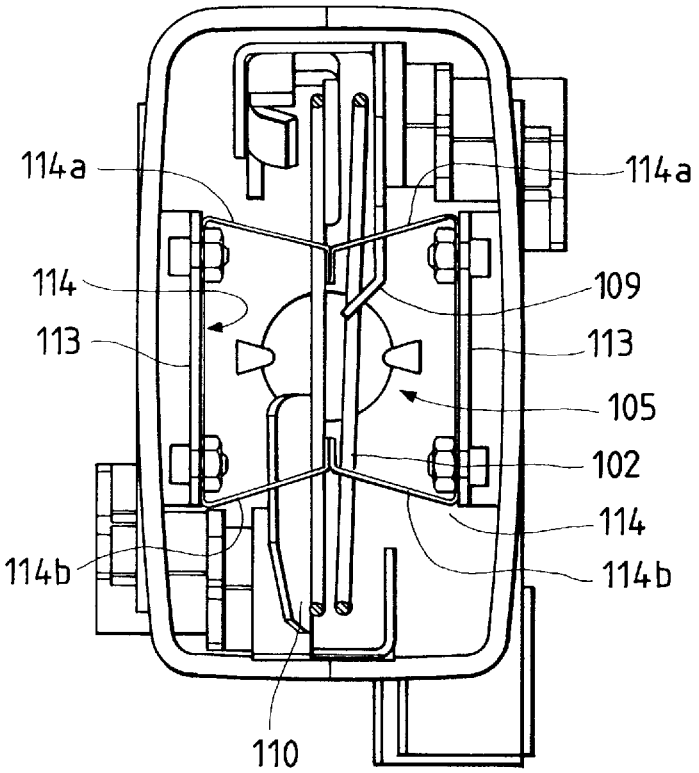
FIG. 7 is a section view taken along the line X—X shown in FIG. 6.
Figure 8:
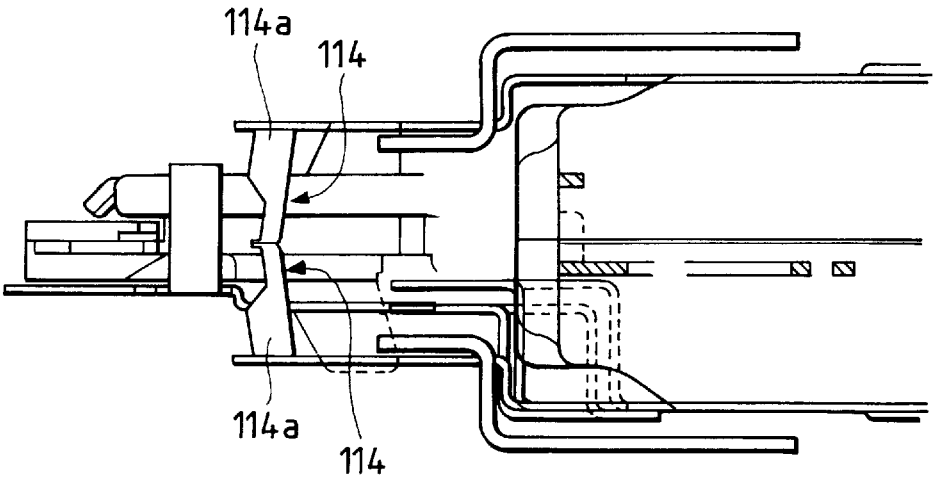
FIG. 8 is a view of the above reinforcement binding machine in part.

FIGS. 6, 7 and 8 respectively show another reinforcement binding machine according to the present invention. The present reinforcement binding machine comprises a wire feed device 103 for feeding out forwardly therefrom a wire 102 wound around a spool 101, a guide part for guiding the fed-out wire 102 in such a manner that the wire 102 can be wound in a loop shape around the intersecting portions of reinforcements a to be bound together, a pair of twisting hooks 105 for gripping part of the wire 102 and twisting and tightening the wire, and a cutting device 106 for cutting off the looped portion of the wire 102 from the base portion of the wire 102. By operating or drawing a trigger lever 107, after the wire 102 fed out by the wire feed device 103 is wound in a loop shape around the reinforcements a and the looped portion of the wire 102 is cut off, the wire looped portion is in part gripped and rotated by the twisting hooks 105 and thus the wire 102 is twisted to thereby wind and tighten the reinforcements a, so that the reinforcements a can be bound together. The wire feed device 103, twisting hooks 105, and cutting device 106 can be operated by a motor (not shown). The basic structures and operations of these components are the same as those disclosed in the above-mentioned publication.

In a main body 108 of the reinforcement binding machine, in order to prevent the looped portion of the wire 102 from swinging in a direction at right angles to the diametrical direction of the loop, there are provided in the upper and lower opposed portions thereof a pair of guide arms 109 and 110 which are respectively arranged so as to hold inside them the wire 102 which is fed out from the guide part 104 and wound around in a loop shape. The two guide arms 109 and 110 are connected to the binding machine main body 108 respectively through two parallel links 111 and 112, while they are arranged such that the mutual distance between them can be adjusted according to the diameters of the reinforcements used.

Also, the binding machine main body 108 includes on the right and left sides thereof a pair of contact plates 113 to be contacted with the reinforcements a which are introduced from between the guide arms 109 and 110.

A pair of C-shaped resistance plates 114 respectively formed of metal springs are fixed to the right and left contact plates 113. And, the upper and lower end pieces 114*a* and 114*b* of the right and left resistance plates 114 are arranged so as to be inserted inside the wire 102 wound in a loop shape by the above-mentioned guide part 104, while the respective leading ends of the end pieces 114*a* and 114*b* are arranged so as to be mutually in contact with each other. Also, the resistance plates 114 are respectively structured such that they can be inserted inside the wire looped portion that has the smallest diameter to be expected by the present reinforcement binding machine.

Figure 9:
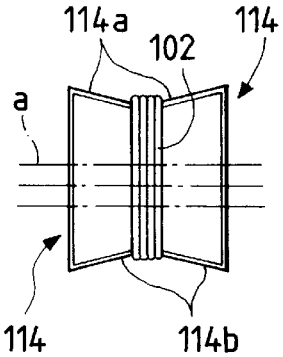
FIG. 9 is an explanatory view to show a state in which a wire is engaged with resistance plates when the wire is wound and tightened.
Figure 10:
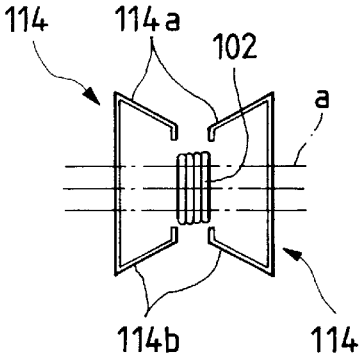
FIG. 10 is an explanatory view to show a state in which the wire is removed from the resistance plates.
Figure 11:
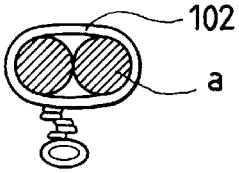
FIG. 11 is an explanatory view to show a state in which the wire binds the reinforcements together when the wire is wound and tightened by a winding and tightening mechanism according to the invention.

Referring to the operation of the reinforcement binding machine having the above-mentioned structure, if the intersecting portions of the reinforcements a are introduced from between the two guide arms 109 and 110 to thereby move the reinforcement binding machine forwardly, then the two contact plates 113 are brought into contact with the reinforcements a. Then, if the trigger lever 107 is operated or pulled toward the operator, then the wire feed device 103 is put into operation to feed out the wire wound around the spool 101, the thus fed-out wire 102 is wound in a loop shape two or more times around the intersecting portions of the reinforcements a by the guide part 104, and, after then, the wire feed device 103 is stopped. Next, at the same time when the wire 102 is cut off by the cutting device 106, the twisting hooks 105 are closed together to grip part of the looped portion of the wire 102 and twist and rotate the wire 102. This causes the wire 102 to wind and tighten the intersecting portions of the reinforcements a and, during this winding and tightening operation, the diameter of the looped portion of the wire 102 is gradually reduced to thereby bring the looped portion of the wire 102 into engagement with the resistance plates 114 disposed inside the wire 102 as shown in FIG. 9, so that a resistance can be elastically applied to the winding and tightening force of the wire 102. Due to this, a tensile force is applied to the wire 102 while it is being twisted. Also, the respective elastic qualities of the two end pieces 114*a* and 114*b* of the resistance plates 114 are weaker as they approach the leading ends thereof, with the result that the wire 102 is collected into the central portion thereof. And, if the diameter of the wire looped portion is reduced further, then the wire 102 is removed from between the two end pieces 114*a* and 114*b* of the right and left resistance plates 114 just before it is contacted with the reinforcements a as shown in FIG. 10, that is, the wire 102 is removed from engagement with the right and left resistance plates 114 and, as shown in FIG. 11, the wire 102 is thereby able to wind and tighten the reinforcements a in such a manner that the wire 102 is in close contact with the reinforcements a. After the reinforcements a are tightened, if the reinforcement binding machine is pulled toward the operator, then the twisting hooks 105 can be removed from the wire 102 and can be opened, while the reinforcements a are held in their bound condition.

Here, when the wire 102 is twisted and rotated by the twisting hooks 5 in such a manner as described above, the wire 2 is given a force which is going to swing the looped portion of the wire 102 laterally in a direction at right angles to the diametrical direction thereof. However, since the looped portion of the wire 102 is held by the upper and lower guide arms 109 and 110, the wire looped portion can be prevented from swinging laterally.

Also, the shape of resistance means for applying a resistance to the wire 102 is not limited to the spring plate shape of the above-mentioned resistance plates 114 but the resistance means may also be structured in such a manner that a non-elastic body is supported by a coil spring.

Figure 12:
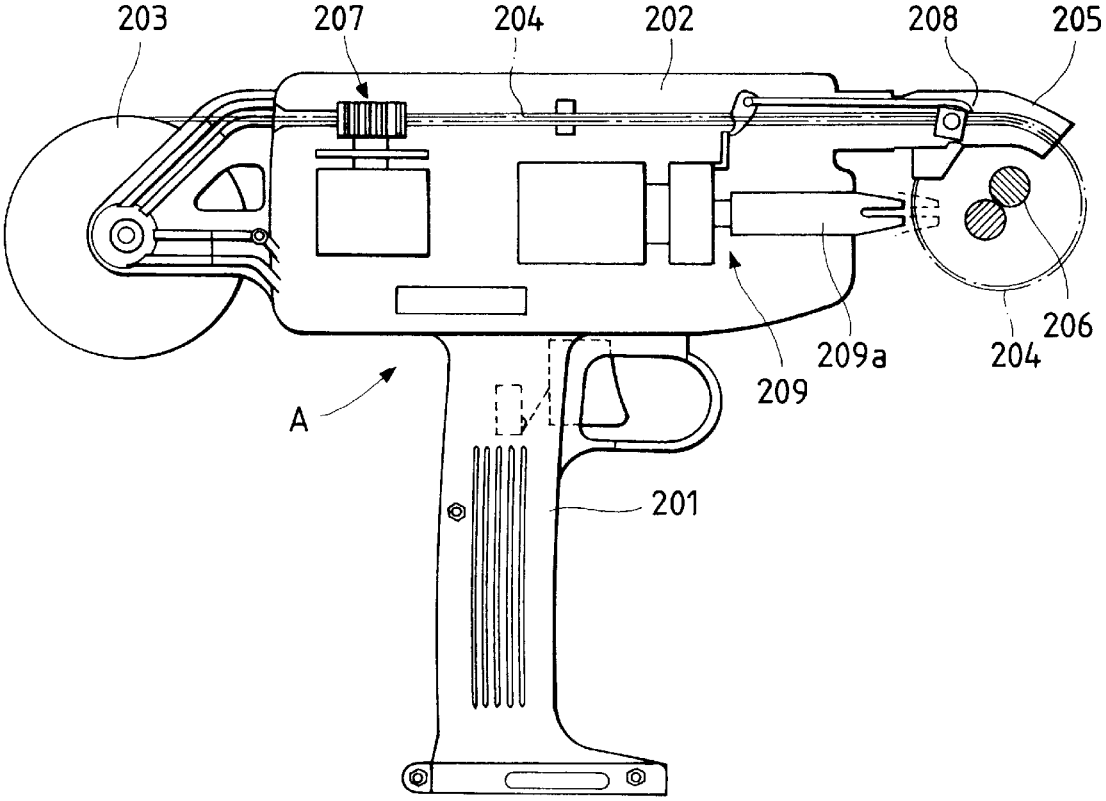
FIG. 12 is a side view of the outer appearance of a reinforcement binding machine which employs a wire terminal end swing preventive mechanism for use in a reinforcement binding machine according to the invention.

In FIG. 12, reference character A designates a still further reinforcement binding machine according to the invention which includes, in the interior of a main body 202 having a grip 201 in the lower portion thereof, a known wire feed mechanism 207 for drawing out a wire 204 from a wire reel 203, bending the wire by means of a bending guide 205 and winding the wire 204 around the peripheries of reinforcements 206 to be bound together, a cutting mechanism 208 for cutting the wire 204 on completion of winding of the wire 204 around the reinforcements 206, and a twisting mechanism 209, after the wire 204 is cut, for gripping and twisting part of the wire wound around the reinforcements.

Figure 13:
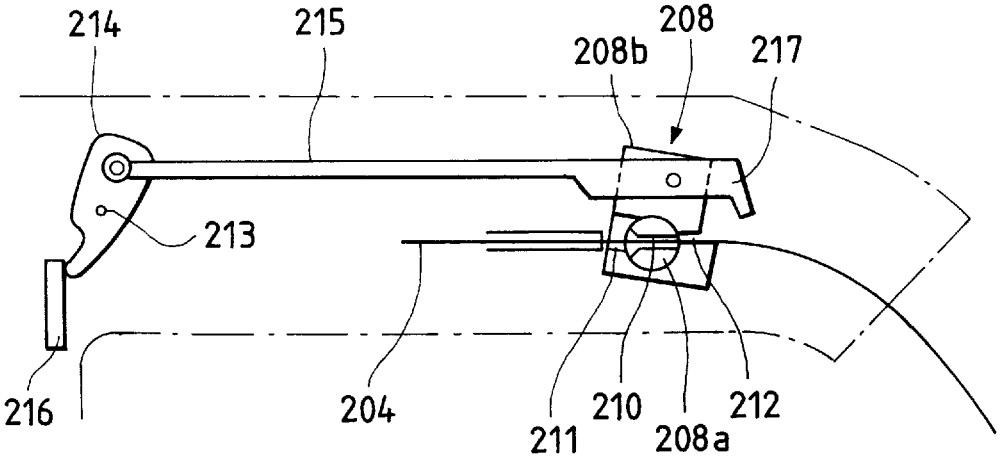
FIG. 13 is an explanatory view to show a state in which the wire terminal end swing preventive mechanism for use in a reinforcement binding machine according to the invention allows a binding wire to pass therethrough.
Figure 14:
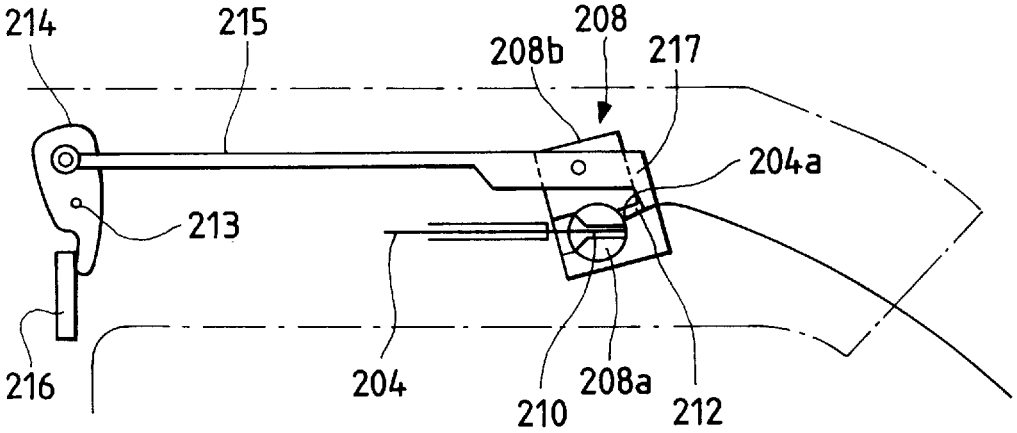
FIG. 14 is an explanatory view to show a state in which the wire terminal end swing preventive mechanism cuts the wire and holds the terminal end portion of the wire.

And, referring to the cutting mechanism 208 which is provided in the above-mentioned reinforcement binding machine A and is used to cut the wire 204, the cutting mechanism 208 includes a stationary edge 208*a* and a movable edge 208*b*: that is, the stationary edge 208*a* is formed in such a circular shape as shown in FIGS. 13 and 14 and includes a through hole 210 which extends in the diametrical direction thereof and through which the wire 204 can be inserted; and, the movable edge 208*b* is rotatably fitted with the outside of the stationary edge 208*a* and includes not only a wire insertion hole 211 formed in the rear portion thereof in the advancing direction of the wire 204 and longer in the vertical direction but also a slit 212 formed in the front portion thereof in the wire 204 advancing direction and serving as an edge. Further, in the cutting mechanism 208, the movable edge 208*b* is connected through a connecting rod 215 with a lever 214 which is rotatable about a pivot 213 serving as a fulcrum, an operation piece 216 operative together with the twisting mechanism 209 of the wire 204 is linked with the passive end of the lever 214, and a hold piece 217 is provided in the end portion of the connecting rod 215 on the movable edge 208*b* side thereof so that the hold piece 217 can cooperate with the lower edge of the slit 212 to hold the terminal end side of the wire 204 between them when the movable edge 208*b* is rotated to cut the wire 204 as shown in FIG. 14.

Figure 15:
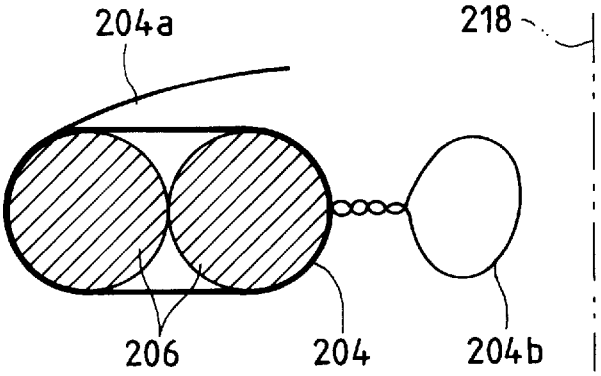
FIG. 15 is an explanatory view to show a state in which the terminal end portion of the wire prevented from being swung by the swing preventive mechanism is stored within the concrete.

In the above-mentioned structure, when the wire 204 is wound in a loop shape around the reinforcements 206 by the wire feed mechanism 207, the lever 214 is not rotated and, for this reason, as shown in FIG. 13, the movable edge 208*b* makes its slit 212 coincide with the insertion hole 210 of the stationary edge 208*a* to thereby allow the wire 204 to pass freely therethrough. And, when the winding of the wire 204 around the reinforcements 206 is completed and then the twisting hooks 209*a* of the twisting mechanism 209 advance and grip between them part of the looped portion of the wire as shown in FIG. 12, as shown in FIG. 14, the operation piece 215 rotates the lever 214 to pull the connecting rod 215 so that the movable edge 208*b* is rotated to make the slit 212 not coincide with the insertion hole 210 of the stationary edge 208*a* to thereby be able to cut the wire 204, when the hold piece 217 provided in the connecting rod 215 cooperates with the lower edge of the slit 212 of the movable edge 208*b* to hold between them the terminal end portion 204*a* of the cut wire in such a manner as shown in FIG. 13. After then, also when the hooks 209*a* are rotated and the wire 204 is twisted in part by the twisting mechanism 209, the terminal end portion of the wire 204 is still held by the hold piece 217. Therefore, after completion of the binding of the wire 204, when the movable edge 208*b* and hold piece 217 are returned and the reinforcement binding machine A is pulled apart from the binding wire 204 as shown in FIG. 13, the terminal end portion 204*a* of the wire 204 remains held to the very end by the reinforcement binding machine A, that is, the wire 204 terminal end 204*a* can be released for the first time only when the reinforcement binding machine A is finally pulled with a stronger force than the holding force. This makes it sure to prevent the terminal end portion 204*a* of the wire 204 from being swung unnecessarily and, after the reinforcement binding machine A is pulled apart from the wire, the terminal end portion 204*a* of the wire can be set stably at such a position as shown in FIG. 15. Therefore, the terminal end portion 204*a* of the wire 204 can be surely positioned within the covering thickness of the concrete 218. Here, in FIG. 15, reference character 204*b* stands for the portion of the wire 204 that is bitten by the twisting hooks.

Figure 16A:
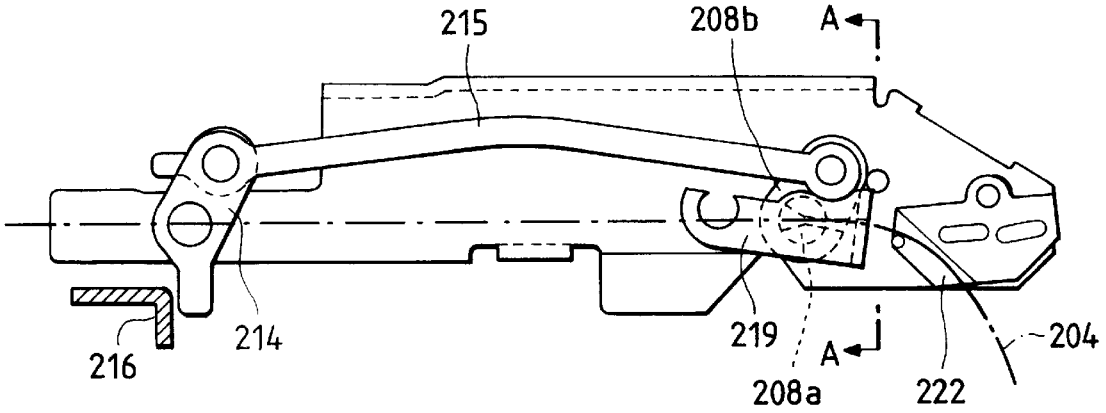
FIG. 16(*a*) is a side view of the outer appearance of another embodiment of the above-mentioned wire terminal end swing preventive mechanism.
Figure 16B:
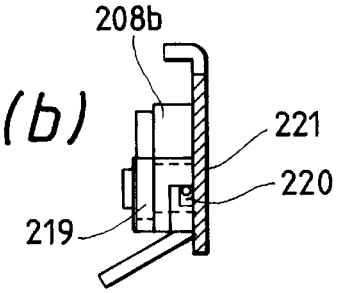

In the above-mentioned embodiment, the terminal end portion of the wire 204 is held by the movable edge 208*b* provided in the cutting mechanism 208 and the hold piece 217 (hold means) provided in the connecting rod 215 for rotating the movable edge 208*b*. However, this is not limitative but, alternatively, as shown in FIGS. 16(*a*) and 16(*b*), a hold member 219 may be fixed to the neighborhood of the stationary edge 208*a*, and there may be provided in the hold member 219 a hold piece 221 (hold means) which is disposed upwardly of the open end of a wire introduction opening 220 formed in the slit 212 of the movable edge 8*b*. Here, in FIGS. 5(*a*) and 5(*b*), 22 designates a guide part for the wire.

Figure 17:
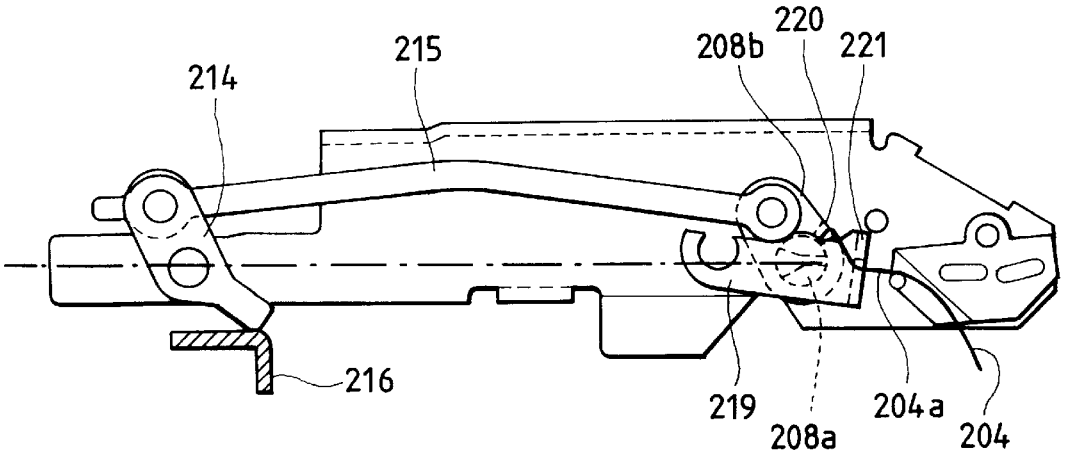
FIG. 17 is an explanatory view of the operation of the above wire terminal end swing preventive mechanism.

After the twisting mechanism 209 is operated in the above-mentioned manner and the operation piece 216 rotates the lever 214 as shown in FIG. 17 to thereby pull the connecting rod 215 so that the movable edge 208*b* is rotated and cuts the wire 204, when the introduction opening 220 of the movable edge 208*b* is moved upwardly, the terminal end portion 204*a* of the wire 204 is also moved along the introduction opening 220 of the movable edge 208*b*. In this case, however, since the portion of the wire terminal end portion 204*a* that moves beyond the introduction opening 220 is prevented from moving upwardly by the hold piece 221, the wire 204 is bent in such a manner as shown in FIG. 17. Accordingly, the terminal end portion 204*a* of the wire 204 is held by the hold member 219 in such a manner that it is prevented from being swung, and the terminal end portion 204*a* of the wire 204 can be released only when the reinforcement binding machine is pulled with a strong force.

Figure 18:
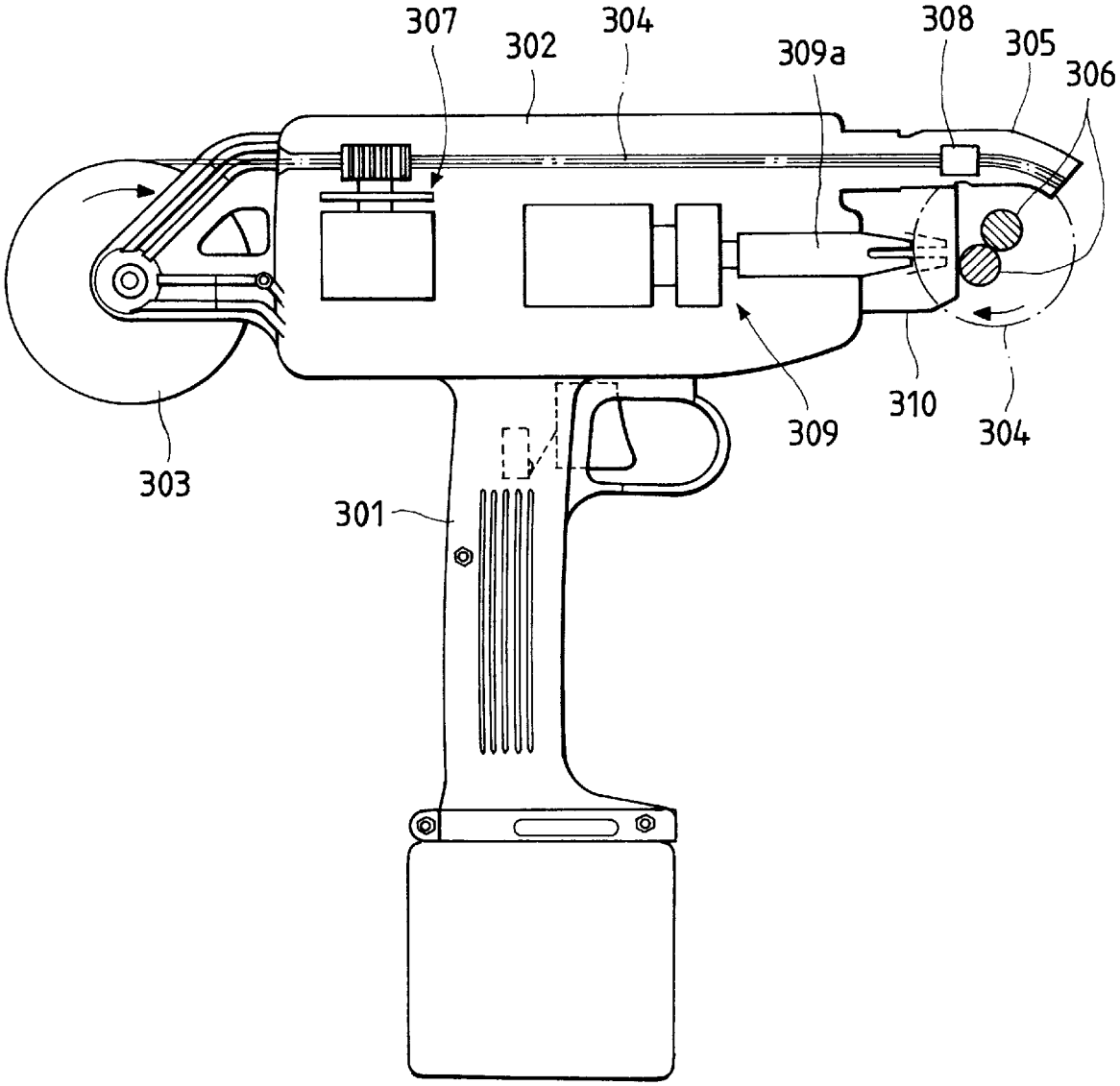
FIG. 18 is a side view of the outer appearance of a still further reinforcement binding machine of the invention which employs a wire guide mechanism for use in a wire binding operation therein.

Now, in FIG. 18, reference character A designates a reinforcement binding machine. The present reinforcement binding machine A includes, in the interior of a main body 302 having a grip 301 in the lower portion thereof, a known wire feed mechanism 307 for drawing out a wire 304 from a wire reel 303, bending the wire 304 by means of a bending guide 305 and winding the wire 304 around the peripheries of reinforcements 306 to be bound together by the wire 304, a wire cutting mechanism 308, on completion of the winding of the wire 304, for cutting the wire 304, and a wire twisting mechanism 309, when the wire 304 is cut, for gripping and twisting part of the portion of the wire 304 that is wound around the reinforcements 306.

Figure 19A:
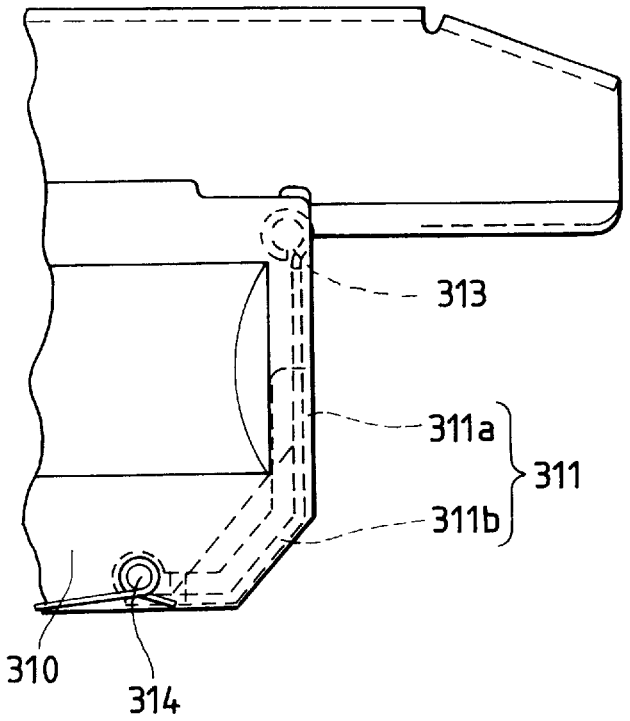
FIGS. 19(*a*) and 19(*b*) are respectively enlarged side and front views of the main portions of the above-mentioned wire guide mechanism.
Figure 19B:
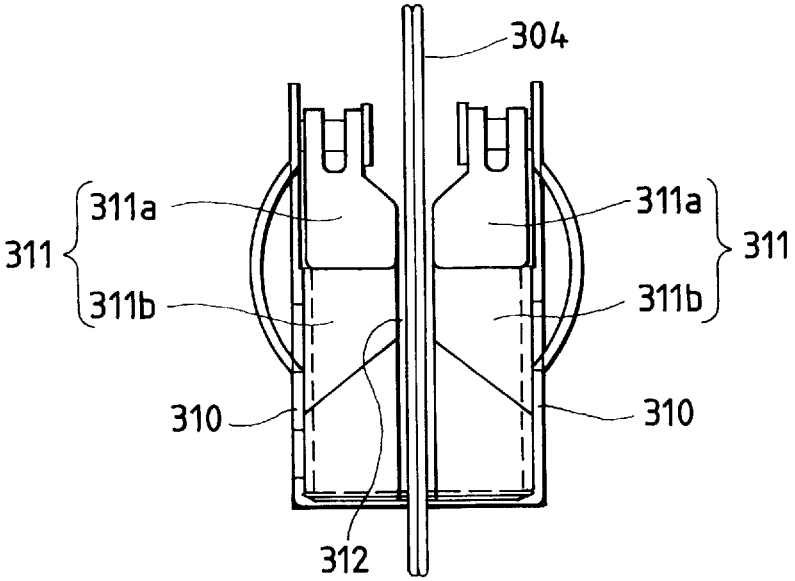

And, on the two right and left sides of the wire twisting mechanism 309, there are disposed two contact plates 310 which can be pressed against the reinforcements 306. Also, inside the front ends of the contact plates 310, as shown in FIGS. 19(*a*) and 19(*b*), there are disposed a pair of right and left guide members 311. Further, inside the two guide members 311, there is formed a longitudinally extending slit-shaped guide part 312 which can guide the wire 304 fed out from the bending guide 305 in such a manner that it is prevented from being swung right and left.

Figure 20:
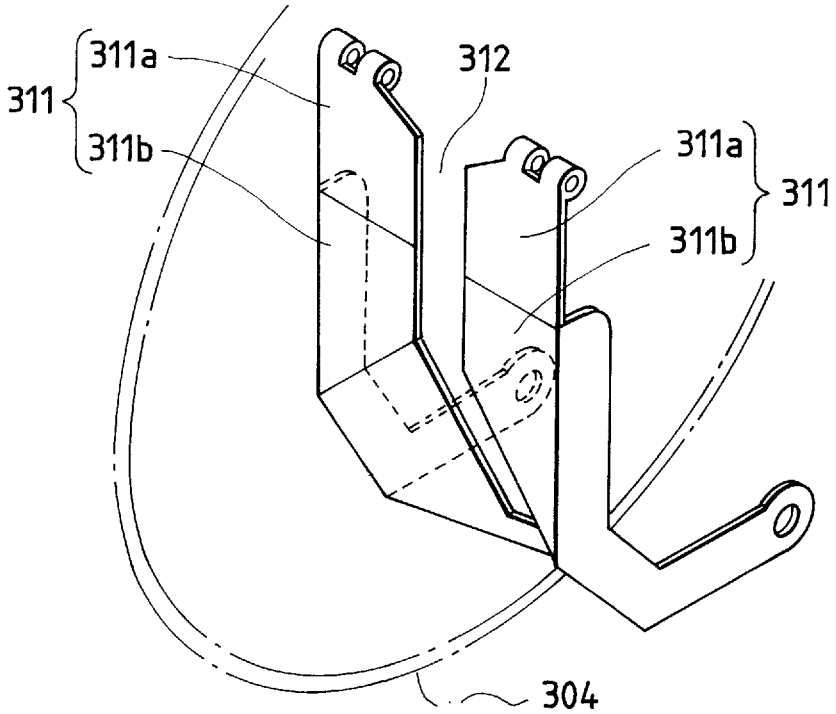
FIG. 20 is a perspective view of the main portions of a guide part employed in the above wire guide mechanism.

Also, as shown in FIGS. 19(*a*), 19(*b*) and 20, each of the two right and left guide members 311 is divided into upper and lower divisional guide sections 311*a* and 311*b*, and the upper portion of the upper divisional guide section 311*a* and the lower portion of the lower divisional guide section 311*b* are pivotally mounted on the pivots 313 and 314 of the contact plates 310 respectively, so that, as shown in FIG. 20, the guide members 311 can be freely opened and closed in the vertical direction. And, the upper and lower divisional guide sections 311*a* and 311*b* are respectively energized in their closing directions by springs. If the two right and left guide members 311 are opened in the vertical direction, the width of the guide part 312 can be spread out.

Figure 22:
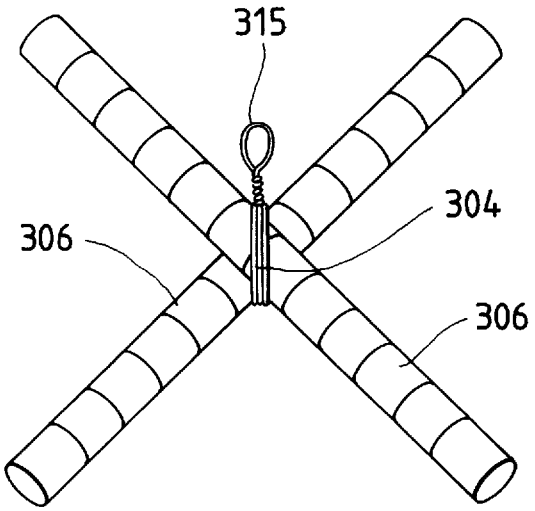
FIG. 22 is an explanatory view of the bound condition of reinforcements bound together according to the above wire guide mechanism.
Figure 23:
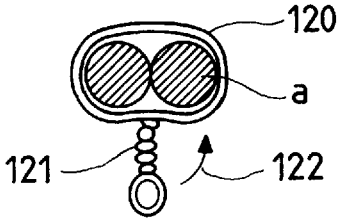
FIG. 23 is an explanatory view to show a state in which the wire binds the reinforcements together when the wire is wound and tightened by a conventional winding and tightening mechanism.
Figure 24:
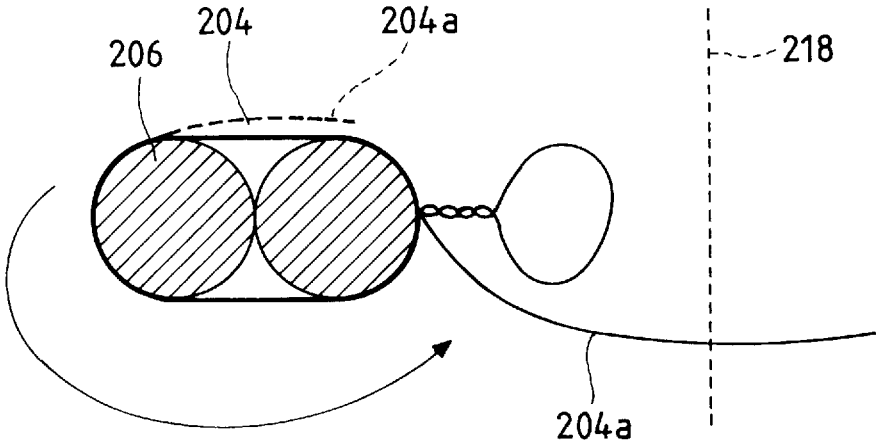
FIG. 24 PRIOR ART
FIG. 24 is an explanatory view of the swung state of reinforcements which are bound together according to a conventional reinforcement binding machine.
Figure 25:
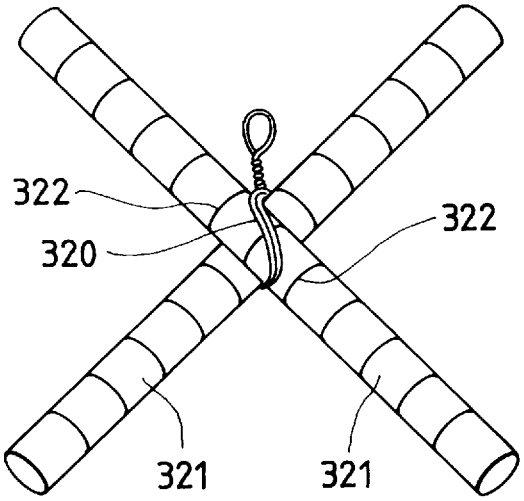
FIG. 25 PRIOR ART
FIG. 25 is an explanatory view of the conventional bound condition of reinforcements bound together.

In the above-mentioned structure, if the front end portions of the contact plates 310 of the reinforcement binding machine are operated while they are pressed against the intersecting portions of the reinforcements 306, then the wire 304 fed out by the wire feed mechanism 307 is given an easily windable property by the bending guide 305 and is then wound around the peripheries of the reinforcements 306. In this case, the wire 304 is guided by the guide part 312 so that it can be wound accurately around the intersecting portions of the reinforcements 306. If the wire 304 is wound a given number of windings, then the wire 304 is cut by the wire cutting mechanism 308 and, further, the wire 304 is gripped in part by the twisting hooks 309*a* of the wire twisting mechanism 309 so that the wire 304 is twisted and tightened. When the twisting hooks 309*a* are rotated, the wire 304 is going to be swung in the rotational direction of the twisting hooks 309*a*. However, as shown in FIG. 19(*b*), since the wire 304 is situated inside the guide part 312, the wire 304 can be prevented from being swung and can be thereby held inside the guide part 312. Due to this, the wire 304 is kept from shifting from the intersecting portions of the reinforcements 306 while it is being twisted and tightened and thus, as shown in FIG. 22, the wire 304 bind the shortest diameter portions of the reinforcements intersecting portions with accuracy.

Figure 21:
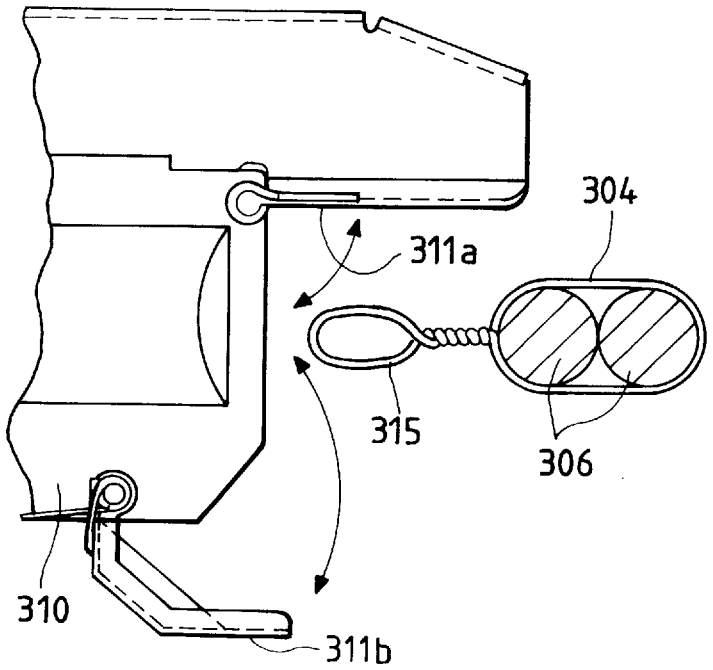
FIG. 21 is an explanatory view of the operation of the above wire guide mechanism.

Here, since the diameter of the twisted portion 313 of the wire 304 bound is larger than the width of the guide part 312, there is a possibility that the twisted portion 313 can butt against the guide part 312 when the reinforcement binding machine is pulled apart from the wire 304 after completion of the binding operation. However, because the upper and lower divisional guide sections 311*a* and 311*b* of the right and left guide members 311 forming the guide part 312 can be opened when they are pushed by the twisted portion 313 as shown in FIG. 21, the guide part 312 can be spread out and the twisted portion 315 can be thereby released externally. Therefore, the present wire guide mechanism can be operated smoothly with no trouble.

Here, the guide members forming the guide part 312 are not limited to the above-mentioned structure that can be opened and closed in the vertical direction. For example, they may be structured such that they can be opened and closed right and left. That is, by opening and closing them right and left, the guide part may be spread out.

As has been described heretofore, in the guide mechanism for use in a wire binding operation according to the invention, since the wire 304 wound around the reinforcements 306 is guided by the guide part 312 in such a manner that it is prevented from being swung when the wire 304 is twisted, the wire 4 is always be able to bind together the shortest diameter portions of the intersecting portions of the reinforcements 306.

According to the invention, since the resistance means is engaged with the wire while it is being twisted by the twisting hooks and a resistance is thereby applied to the winding and tightening force of the wire elastically, it is possible to twist the wire while applying a tensile force to the wire. This not only makes it possible to obtain a strong and stable binding force but also eliminates the need to twist the wire while pulling the wire in one direction as in the prior art. This in turn avoids the need for a troublesome operation to bend the long extended wire twisted portion after the reinforcements are bound together, thereby being able to improve the operationability of the present reinforcement binding machine.

As has been described heretofore, according to the wire terminal end swing preventive mechanism of the invention for use in a reinforcement binding machine, since the terminal end portion of the cut wire is held in such a manner that it is prevented from being swung, even when the reinforcement binding machine is pulled apart from the wire that has bound the reinforcements, the terminal end portion of the wire can be surely stored within the covering thickness of the concrete and can also be surely prevented from moving out externally of the surface of the concrete.

What is claimed is:

1. A twisting-and-tightening mechanism for a reinforcement binding machine in which a wire feed device feeds externally therefrom a wire for binding reinforcements and in which a portion of the wire fed out by the wire feed device is bent in a loop shape around the reinforcements by a guide part, the twisting-and-tightening mechanism comprising:

twisting means having a pair of hooks being capable of opening and closing for gripping in part the loop-shaped portion of the wire wound around the reinforcements;

means for rotating the twisting means in a direction to twist the wire gripped by the hooks and for selectively moving the twisting means toward or away from the reinforcements with the wire wound therearound; and means for urging the twisting means such that the twisting means is normally spaced apart from the reinforcements.

2. The twisting-and-tightening mechanism according to claim 1, wherein the urging means comprises a coil spring.

3. The twisting-and-tightening mechanism according to claim 1, further comprising:

resistance means disposed inside the loop-shaped portion of the wire and engageable with the wire during the wire twisting operation for applying elastic resistance to the wire.

4. The twisting-and-tightening mechanism according to claim 3, wherein the resistance means comprises:

a pair of resistance plates, each having a C-shape; and means for bringing the pair of resistance plates in contact with each other with a predetermined force.

5. A tension applying mechanism for a reinforcement binding machine in which a wire feed device feeds externally therefrom a wire for binding reinforcements and in which a portion of the wire fed out by the wire feed device is bent in a loop shape around the reinforcements by a guide part, and a twisting-and-tightening mechanism twists and tightens the wire thus bent in the loop shape, the tension applying mechanism comprising:

a pair of resistance plates, each having a C-shape, which are disposed inside the loop-shaped portion of the wire and are engageable with the wire during the wire twisting operation by the twisting-and-tightening mechanism, for applying elastic resistance to the wire; and means for bringing the pair of resistance plates in contact with each other with a predetermined force.

6. A reinforcement binding machine in which a feed mechanism feeds out a binding wire in a loop shape around reinforcements to be bound and a twisting mechanism grips and twists in part the loop-shaped wire, the reinforcement binding machine comprising:

a wire cut and swing-preventive mechanism including a cutting mechanism for cutting the wire and holding means operatively coupled to said cutting mechanism for holding a terminal end portion of the wire when cut, wherein the holding means holds the terminal end portion of the wire in response to the operation of the cutting mechanism; and means for selectively moving the twisting mechanism toward the reinforcements to engage the loop-shaped wire and away from the reinforcements after twisting has been completed.

7. A reinforcement binding machine in which a feed mechanism feeds out a binding wire in a loop shape around reinforcements to be bound and a twisting mechanism grips and twists in part the loop-shaped wire, the reinforcement binding machine comprising:

a wire-bending guide extending from the feed mechanism, wherein the wire-bending guide has a groove for bending the wire fed by the feed mechanism into a wire loop lying substantially in a plane; and wire guide means for receiving said wire loop and engaging opposite sides of said wire loop to maintain said loop in said plane during twisting of said wire loop.

8. A reinforcement binding machine in which a feed mechanism feeds out a binding wire in a loop shape around reinforcements to be bound and a twisting mechanism grips and twists in part the loop-shaped wire, the reinforcement binding machine comprising:

a wire guide mechanism including a longitudinally extending slit-shaped guide part formed in front of the wire twisting mechanism, for guiding the wire thus fed out, the guide part being adapted to be spread apart;

a cutting mechanism for cutting the wire;

holding means operatively coupled to said cutting mechanism for holding a terminal end portion of the wire when cut, wherein the holding means holds the terminal end portion of the wire in response to the operation of the cutting mechanism; and means for selectively moving the twisting mechanism toward the reinforcements to engage the looped wire and away from the reinforcements after twisting has been completed.

9. A reinforcement binding machine for binding reinforcements with a wire, comprising:

a wire feed device for feeding externally therefrom the wire;

a bending guide part for bending a portion of the wire into a loop shape around the reinforcements;

twisting means having a pair of hooks being capable of opening and closing for gripping in part the loop-shaped portion of the wire wound around the reinforcements;

means for rotating the twisting means in a direction to twist the wire gripped by the hooks and for selectively moving the twisting means toward or away from the reinforcements with the wire wound therearound;

a coil spring for urging the twisting means such that the twisting means is normally spaced apart from the reinforcements;

a pair of resistance plates, each having a C-shape, which are disposed inside the loop-shaped portion of the wire and are engageable with the wire during the wire twisting operation by the twisting means, for applying elastic resistance to the wire;

a pair of contact plates on which the respective resistance plates are attached;

a longitudinally extending slit-shaped guide part formed in front of the hooks of the twisting means for guiding the wire thus fed out, the guide part being spreadable in a width thereof;

a cutting mechanism for cutting the wire; and holding means operatively coupled to said cutting mechanism for holding a terminal end portion of the wire when cut.

* * * * *